US005123342A

United States Patent [19]

Camossi

[11] Patent Number: 5,123,342

[45] Date of Patent: Jun. 23, 1992

[54] MECHANICAL LOW-NOISE PRESS

[75] Inventor: Roberto Camossi, Lumezzane Gazzolo, Italy

[73] Assignee: Vaccari S.P.A., Vicenza, Italy

[21] Appl. No.: 359,692

[22] Filed: May 31, 1989

[30] Foreign Application Priority Data

May 31, 1988 [IT] Italy ..... 5172 A/88

[51] Int. Cl.[5] ..... B30B 1/18

[52] U.S. Cl. ..... 100/289; 72/454; 83/631; 100/259; 100/299; 184/5

[58] Field of Search ..... 100/43, 48, 289, 280, 100/270, 230, 259, 214, 231, 299; 184/5; 72/454; 83/631; 74/424.8 R

[56] References Cited

U.S. PATENT DOCUMENTS

| | | | |
|---|---|---|---|
| 3,482,463 | 12/1969 | Huydts et al. | 100/289 X |
| 3,817,352 | 6/1974 | Bourgeois et al. | 100/289 X |
| 3,827,354 | 8/1974 | Bredebusch | 100/289 |
| 4,523,521 | 6/1985 | Huydts | 100/289 X |

FOREIGN PATENT DOCUMENTS

| | | | |
|---|---|---|---|
| 191741 | 9/1957 | Australia | 100/289 |
| 2851551 | 6/1980 | Fed. Rep. of Germany | 100/289 |
| 653758 | 3/1963 | Italy | 184/5 |
| 591335 | 2/1978 | U.S.S.R. | 100/289 |
| 775501 | 11/1980 | U.S.S.R. | 184/5 |

*Primary Examiner*—Philip R. Coe
*Assistant Examiner*—Stephen F. Gerrity
*Attorney, Agent, or Firm*—Birch, Stewart, Kolasch & Birch

[57] ABSTRACT

The present invention concerns a mechanical, low-noise press, particularly of the screw type, comprising a tup-bearing ram connected with a driving screw, rotatably connected with a lead nut, which is integrally fixed on the frame supporting the press. The press also comprises sealing means which define, together with the mating surfaces of the screw and of the lead nut, a chamber, having a pre-determined volume, adapted to collect an incompressible medium, such as a lubricating oil, and a circulation mechanism in order to maintain within the chamber a controlled delivery of the medium, which delivery insures the presence of a constant spacing film of medium between the mating surfaces during the operation phase of the press, so as to prevent the direct contact between the screw and the lead nut, thereby absorbing the vibrations and the collisions generated by their interaction.

13 Claims, 2 Drawing Sheets

MECHANICAL LOW-NOISE PRESS

BACKGROUND OF THE INVENTION

The present invention concerns a mechanical, low-noise press, and particularly but not exclusively a screw press of the fly or friction type.

Known types of presses comprise a ram bearing a striking mass or tup, driven by a sturdy screw with a practically vertical axis, which engages a fixed nut thread which is integrally mounted on the machine's vertical posts.

The displacement of the tup is obtained by rotating the screw, generally by means of a central wheel keyed on its axis, such wheel being alternatively brought into contact with two lateral wheels, which are driven in opposite directions by a motor, so that one of the wheels controls the upward movement, the other one the downward movement of the tup.

These presses, as well as others, are usually rather noisy, not so much because of the impact of the tup on the piece being formed or on the die, but rather because of the impact and collision between the screw and the nut thread during the recovery of their mating backlash, following the action of the tup during the working phase.

In fact, during the collision of the tup against the piece to be formed, its kinetic energy is transformed, in part, into deformation and heat transferred to the piece and, in part, it is transmitted to the screw and the nut thread, thereby generating very high friction and overheating between the contacting surfaces, with subsequent mechanical and acoustic vibrations of very high intensity.

The noise level is further enhanced by the fact that, in general, the screw is made of high-resistance steel and the nut-thread is made of bronze, which materials give rise to different resonance phenomena induced by collisions and vibrations. Heretofore, many attempts have been made to reduce the noise level of such presses, mostly striving to acoustically insulate the structure of the machines from the rooms containing them, with rather unsatisfying results and at fairly high expense.

As is known in all the machines of this type a centralized, automatic, normal lubrication system is provided which obviously involves also the screw and nut-thread coupling. However, the lubrication practically has no influence on the noise and the acoustic behavior of the assembly.

In German patent application DE-A-2 851 551, a screw press is described which comprises a lubrication and cooling device for the screw/nut thread assembly, having the purpose of solving the problem of overheating of the two components during the working phase of the press. One attempt to solve the overheating problem is made by means of ducts arranged near the meshing threads, wherein a cooling medium, in a liquid or gas form, is forced through the ducts. The medium is collected into a supply tank and brought into circulation by means of a pump or by gravity, after it has been cooled in a suitable external heat-exchanger. In a particular embodiment, the liquid medium is oil which is collected in a chamber formed between the bottom walls of the screw and the nut thread, which together form a piston/cylinder assembly.

Although this device improves the working conditions of the press and permits a reduction in the clearances between the screw and the nut thread, it is not without inconveniences since it leaves practically unchanged the contact conditions between the two main components and thus it does not help to decrease the noise level of the assembly.

SUMMARY OF THE INVENTION

The main object of the present invention is to eliminate the above-mentioned disadvantages, by providing a low-noise press of the screw type which affords actual and dramatic reduction of the loudness of such a machine, bringing about, at the same time, a further improvement in its working conditions.

Another object of the invention is that of providing a low-noise press of such a simple structure as to make it possible to apply the screw/nut thread arrangement even on already existing machines, without substantially modifying their original structure.

A further object is that of creating a low-noise press which is technically reliable and easy to build by using components and materials which are presently available on the market, so as to be competitive from a purely economic point of view.

The above mentioned objects and others are accomplished in accordance with the present invention, generally speaking, in a mechanical press, in particular of the screw type, which comprises a ram or tup, connected with a driving screw which is rotatably connected with a nut thread integrally mounted on a supporting frame of the press, characterized in that it comprises a sealing means, which delimits, together with the mating surfaces of the screw and nut thread, at least one chamber presenting a pre-determined volume, suited to collect an incompressible medium, such as lubricating oil, and means for the circulation of the medium in order to maintain through such a chamber a controlled delivery of the medium, so as to insure the presence of a spacing film of medium between the mating surfaces during the phase of the screw displacement, so as to prevent, during such phase, the direct contact between the screw and the nut thread, and to absorb the vibrations and the collisions caused by their inter-action.

The device of the present invention presents the advantages of:

- considerably reducing the overall noise of the machine;
- improving the mating between the screw and the nut thread, thereby reducing their wear;
- improving the lubrication system of the two mating elements and of the accessory elements;
- increasing the performance and the life-span of the machine; and
- improving the working environment of the machine operators, while reducing environmental pollution.

BRIEF DESCRIPTION OF DRAWINGS

Further scope of applicability of the present invention will become apparent from the detailed description given hereinafter and from the enclosed drawings. However, it should be understood that the detailed description and specific examples, while indicating preferred embodiments of the invention, are given by way of illustration only, since various changes and modifications within the spirit and scope of the invention will become apparent to those skilled in the art from this detailed description and from the drawings, wherein.

DETAILED DISCUSSION

Figure 1:
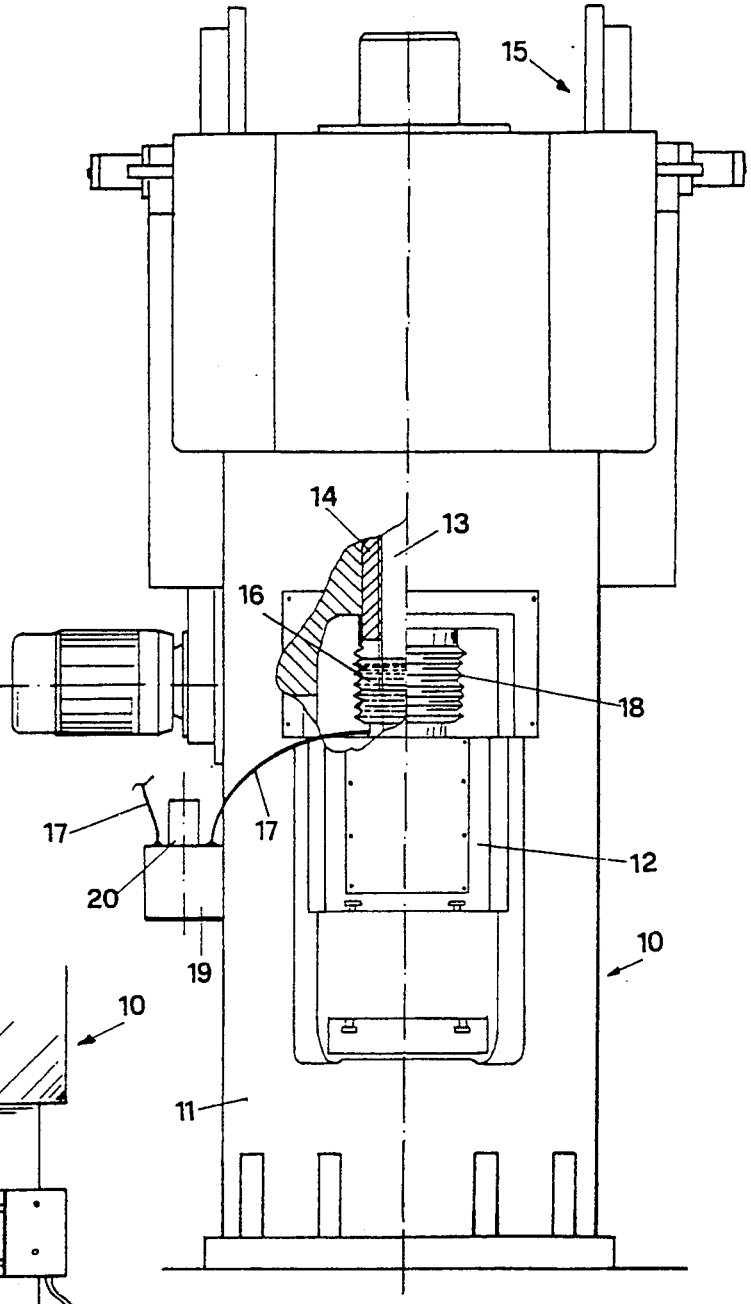
FIG. 1 represents a schematic front view of a screw press, which is partially sectioned, in order to show a first embodiment of the device according to the present invention.
Figure 2:
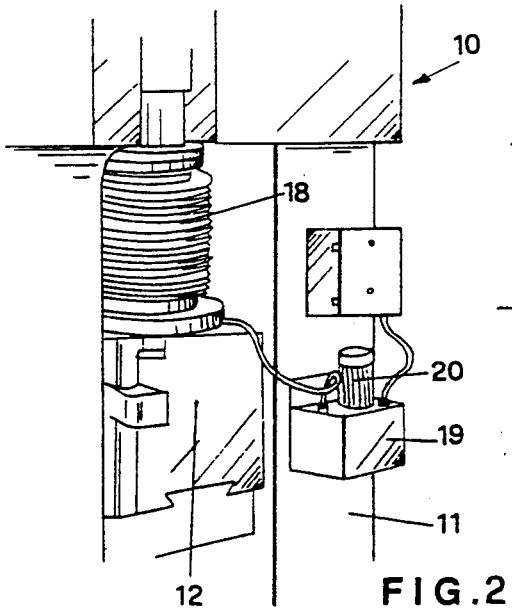
FIG. 2 represents a detailed perspective view of a portion of the press of FIG. 1.

With reference to the mentioned FIGS. 1 and 2, a screw press comprises essentially a supporting frame 10 with two posts 11 between which a ram 12, bearing a striking mass or tup, is vertically driven. Ram 12 is connected at the lower end of a driving screw 13, which engages a nut thread 14, which is integrally fixed on frame 10 and driven by a motor assembly, for instance of the fly-type.

According to the invention, sealing means are present, which delimit at least one chamber 16, presenting a pre-determined volume, which has the task of collecting an incompressible medium, preferably lubricating oil, and of keeping it between the mating surfaces of the screw 13 and the nut thread 14.

These sealing means may consist of a flexible sleeve 18, having the shape of a bellows, which can expand and contract depending on the strokes of the tup-bearing ram 12. The flexible sleeve 18 surrounds the driving screw 13, so that the medium contained therein is sent to at least one part of the mating surfaces of the screw and the nut thread. The ends of the sleeve are sealed by means of a upper metal ring to the nut thread 14 and by means of an lower metal ring to ram 12.

As an alternative, chamber 16 can be delimited by stiff sleeve elements—not represented in the drawings—which are arranged around the screw 13 and are telescopically joined together, some of them being fixed on the ram, the others on the lead nut.

Similarly it will also be possible to provide such a chamber in the upper part of the screw and of the nut thread, or at both positions of the elements, so as to include the entire area of the mating surfaces.

The incompressible medium is introduced into chamber 16 through the ducts 17. The circulation of the medium within the chamber or chambers can be realized in a forced way, starting from a reserve tank 19, by means of a pump 20.

As an alternative, the medium can be introduced by cascading, starting from a tank placed at a suitable height. The discharge of the medium from chamber 16 can be realized by means of independent ducts—not shown in the drawings—and it can eventually be controlled by valve means, also not represented in the drawings. In any case, in chamber 16 there is constantly some medium, although in varying quantities, mutually spacing the mating surfaces of the screw and the nut thread. More precisely, between the mating threads, or at least a part thereof, there is a spacing film which prevents, or at leasts limits, the direct contact between the mating elements, so as to prevent them from colliding and to dampen the vibrations.

Surprisingly, this solution decreases the cause of the loud noise which characterizes the previous technique, so that the assembly has a considerably reduced loudness.

Figure 3:
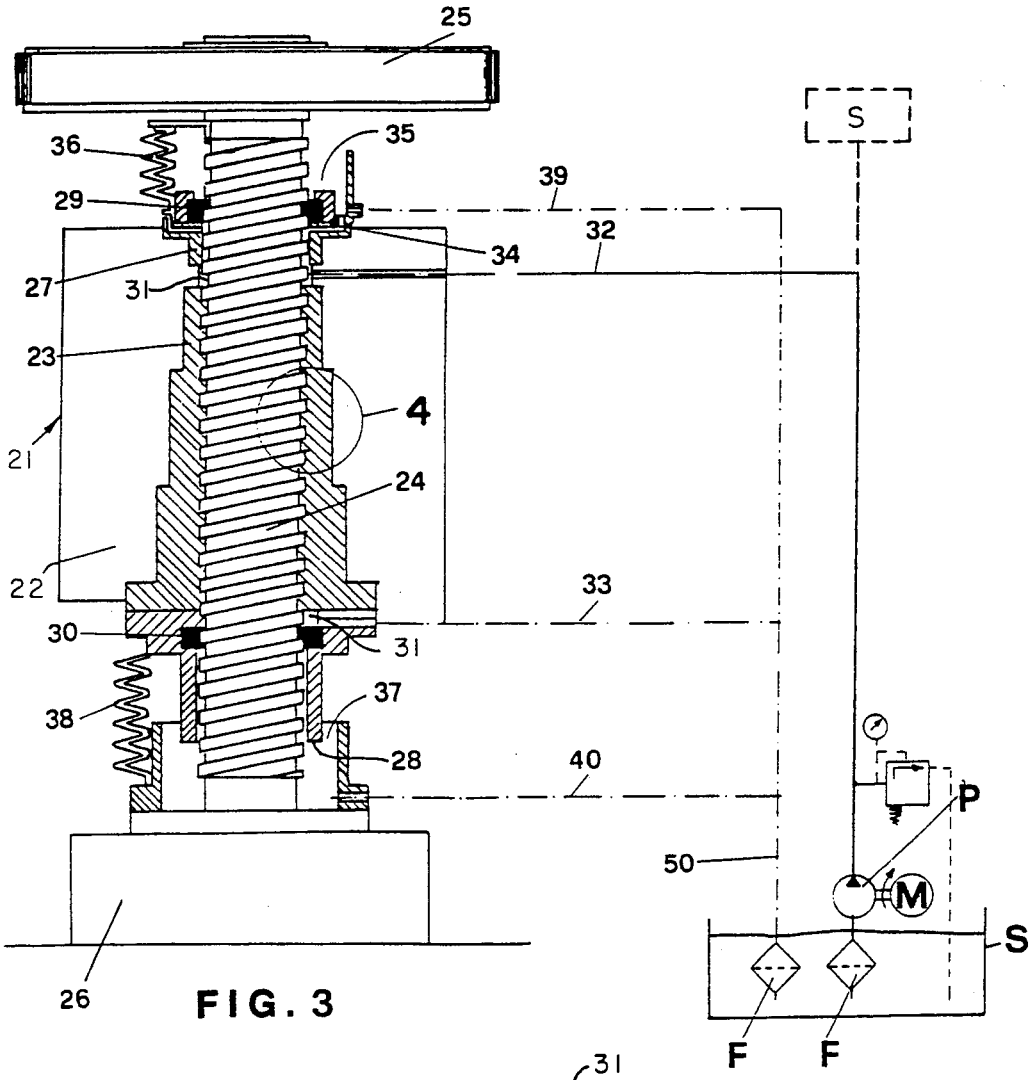
FIG. 3 represents a schematic view in detail of a press representing a second embodiment of the device according to the present invention.

A second embodiment of the invention will now be described in detail with special reference to FIG. 3, wherein for the sake of clarity some of the previously described elements constituting the machine have not been represented.

In detail, the nut thread 21, indicated as a whole, comprises a fixed frame 22, presenting a toroidal shape, which encloses and supports a lead nut 23. A screw 24 is connected with a pre-determined tolerance with the lead nut 23 and bears on its upper end a flywheel 25 and on its lower end a ram or tup 26.

At the ends of the lead nut 23 there are two fixed pilot sleeves indicated by 27 and 28, respectively. The upper face of the pilot sleeve 28 forms an abutting element for the upward movement of tup 26. Attached to the pilot sleeves 27 and 28 there are ring-shaped seals 29 and 30, made of metal or synthetic antifriction materials.

Figure 4:
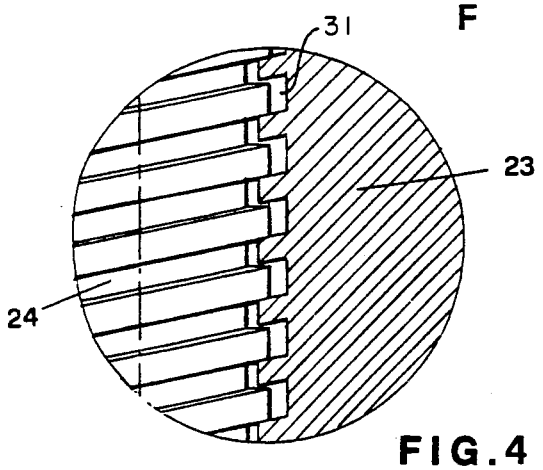
FIG. 4 represents an enlarged sectional view of the portion 4 of FIG. 3.

The ring-shaped seals delimit, together with the threaded surfaces of the lead nut and of the screw, chamber 31, adapted to collect the lubricating medium, as better shown in FIG. 4.

At the end portions of chamber 31 there are the ducts 32 and 33, for the inlet and outlet of the medium, respectively. The oil can be forced through chamber 31 and the ducts 32 and 33 by means of a hydraulic pumping unit, comprising a pump P, a supply tank S and filter elements F.

As an alternative, the circulation of the medium can be accomplished by gravity, starting from a supply tank $S_1$ placed at a suitable height, supplied in turn by the central lubrication circuit of the press.

In both cases, the medium delivery is so abundant and, at any rate, sufficient to insure the constant presence of oil in chamber 31 while the machine is on operation.

Advantageously, at the top of the delivery duct 32, there is a venting orifice 34, opening to the atmosphere, so as to allow the chamber 31 to be purged of air and to be completely filled-up. The excess oil, overflowing from the venting orifice 34 and possibly also from the ring-shaped seal 29, will be collected in a first annular zone, which is partially enclosed by an elastic, deformable bellows 36, following the displacement of the screw. Similarly, the oil overflowing from the lower ring-shaped seal 30 will be collected in a second annular zone 37, which is also partially enclosed by an elastic bellows 38 or by a similar protecting element.

In order to complete the description, it will be added that the pilot sleeve 28, which forms the abutting ledge for the tup 26, presents a height which extend lower than the walls of the annular zone 37, in order to prevent any deformation of the latter at the moment of the impact of the tup with the piece being formed.

Moreover, the annular zones 35 and 37 are provided with the drainage ducts 39, 40 which are connected with the outlet duct 33 and the collecting tank through a backflow duct 50.

Similarly to what has been previously described concerning the first embodiment of the invention, also in this case, the medium is caused to circulate through chamber 31, where it creates a spacing film or liquid buffer between the threaded surfaces of the screw and of the lead nut, thereby preventing their contact during the active phases of the screw, particularly at the moment of impact of the tup on the piece to be formed. In this connection, it can be observed that in the movement of the threaded surfaces relative to the interposed medium, a boundary layer is created, whose lift effect is similar to that of the plain bearings, this lift effect attaining its maximum thickness at the final part of the ram stroke.

Finally it will be remarked that the above-described arrangement for reducing loudness can be applied with the appropriate modifications even to presses with different driving systems, such as toggle presses or eccentric-shaft presses.

The present press may include various changes and modifications which will, however, not exceed the scope of the invention, as defined in the appended claims.

I claim:

1. A mechanical, low-noise press comprising:

a tup-bearing ram connected with a drive screw, said screw having meshing surfaces;

a lead nut integrally mounted on a supporting frame of said press, said lead nut having meshing surfaces which mesh with said meshing surfaces of the screw;

a sealing means which defines together with said meshing surfaces of said screw and said lead nut a chamber having a pre-determined volume, said chamber being adapted to collect an incompressible medium;

said sealing means comprising a pair of ring-shaped seals at proximate ends of said lead nut;

a flexible protective sleeve juxtapositioned to each of said ring-shaped seals forming respective collection chambers for collection of any excess medium overflowing from said seals; and means for providing continuous circulation of said incompressible medium so as to maintain through said chamber a controlled delivery of said medium to insure continuous presence of a spacing film of said medium between said meshing surfaces of said screw and said lead nut during operation of said press, thereby preventing direct contact between said screw and said lead nut, and dampening vibrations and collisions generated during their interaction.

2. A low-noise press according to claim 1, wherein said means for the circulation of said medium comprises at least one inlet duct and one outlet duct connected with said chamber.

3. A low-noise press according to claim 2, wherein said inlet and outlet ducts are further connected to a supply tank for said medium, said medium being forced through said ducts by means of a pump.

4. A low-noise press according to claim 2, wherein said incompressible medium is supplied by gravity from a supply tank arranged at an appropriate height above said inlet duct to said chamber.

5. A low-noise press according to claim 1 wherein said chamber has at its upper end a venting orifice open to the atmosphere.

6. A low-noise press according to claim 1, further including drainage ducts connecting said collection chambers with a supply tank.

7. A low-noise press according to claim 1, wherein said chamber extends along an entire length of said lead nut and further includes an annular zone above an upper end of said lead nut.

8. A mechanical, low-noise press comprising:

a tup-bearing ram connected with a drive screw, said screw having meshing surfaces;

a lead nut integrally mounted on a supporting frame of said press, said lead nut having meshing surfaces which mesh with said meshing surfaces of the screw;

a sealing means which defines together with said meshing surfaces of said screw and said lead nut a chamber having a pre-determined volume, said chamber being adapted to collect an incompressible medium;

said sealing means comprises an extensible wall which surrounds at least one end of said screw, one end of said extensible wall being attached to said tup-bearing ram, the other end thereof being fixed to a portion of said lead nut, so that said chamber has a variable volume; and means for providing continuous circulation of said incompressible medium, including ducts connected with said chamber for the circulation of said medium and for the discharge of air from said chamber, so as to maintain through said chamber a controlled delivery of said medium to insure continuous presence of a spacing film of said medium between said meshing surfaces of said screw and said lead nut during operation of said press, thereby preventing direct contact between said screw and said lead nut, and dampening vibrations and collisions generated during their interaction.

9. A low-noise press according to claim 8, wherein said extensible wall consists of a flexible sleeve.

10. A low-noise press according to claim 8, wherein said extensible wall consists of a plurality of telescopic sleeve elements arranged around the screw, some of which the sealed to said lead nut, others of which are sealed to said tup-bearing ram.

11. A low-noise press according to either claim 9 or 10, wherein said chamber is formed in an upper section of said lead nut near an upper support of said screw.

12. A low-noise press according to either claim 9 or 10, wherein said chamber is formed in a lower section of said lead nut near said tup-bearing ram.

13. A low-noise press according to either claim 9 or 10, wherein said chamber comprises an upper section, near an upper end of said lead nut, and a lower section, near a lower end of said lead nut.

* * * * *